US006394878B1

(12) United States Patent
Wang

(10) Patent No.: US 6,394,878 B1
(45) Date of Patent: May 28, 2002

(54) MOUNTING BRACKET STRUCTURE OF REMOTELY CONTROLLABLE TOY RALLY CAR

(75) Inventor: Li-Chieh Wang, Sanchung (TW)

(73) Assignee: Kingstar/Neo Co., Ltd. (TW)

( * ) Notice: Subject to any disclaimer, the term of this patent is extended or adjusted under 35 U.S.C. 154(b) by 0 days.

(21) Appl. No.: 09/725,185

(22) Filed: Nov. 29, 2000

(51) Int. Cl.[7] ..... A63H 30/00
(52) U.S. Cl. ..... 446/469; 446/454
(58) Field of Search ..... 280/755; 446/465, 446/466, 469, 427, 448, 454

(56) References Cited

U.S. PATENT DOCUMENTS 4,696,655 A * 9/1987 D'Andrade et al. ..... 446/469
5,322,469 A * 6/1994 Tilbor ..... 446/466
5,338,246 A * 8/1994 Suto ..... 446/466

* cited by examiner

*Primary Examiner*—Jacob K. Ackun
(74) *Attorney, Agent, or Firm*—Troxell Law Office PLLC

(57) ABSTRACT

Mounting bracket structure of remotely controllable toy rally car, including a mounting bracket, intersecting linkages, rebounding shock-absorbers and front and rear support racks on which wheels are mounted. The mounting bracket includes at least two lateral supports racks. Each intersecting linkage includes two intersecting links. The intersecting linkages and the rebounding shock-absorbers are connected between the mounting bracket and the front and rear support racks to support the mounting bracket. The top ends of the intersecting linkages are connected to the mounting bracket between the lateral support racks. The bottom ends of the intersecting linkages are respectively connected to the front and rear support racks. The rebounding shock-absorbers are bridged between outer ends of the lateral support racks and the bottom ends of the intersecting linkages. The height of the mounting bracket is increased and the mounting bracket itself is adapted to poor road condition and has a resilient shock-absorbing ability against lateral tilting to assist the shock-absorbers disposed between the wheels and the front and rear support racks. Therefore, the toy rally car can run more stably.

20 Claims, 6 Drawing Sheets

MOUNTING BRACKET STRUCTURE OF REMOTELY CONTROLLABLE TOY RALLY CAR

BACKGROUND OF THE INVENTION

The present invention relates to a mounting bracket structure of remotely controllable toy rally car. The mounting bracket structure includes intersecting linkages and assistant rebounding shock-absorbers which are connected between the mounting bracket and the front and rear support racks to support the mounting bracket. The mounting bracket has increased height and is adapted to varied road configurations. The mounting bracket itself has a resilient shock-absorbing ability against lateral tilting so that the toy rally car can run more stably under poor road condition.

The existent conventional remotely controllable model cars carry various kinds of equipments which simulate the parts of a real car. It is known that a model car has a not so heavyweight. Referring to FIG. 6, with respect to a four-wheel model car, the mounting chassis 70 is made of a panel with large area. The gap between the chassis 70 and the wheels 71 is very short so that the buffering distance is quite limited. As a result, even though the model car is equipped with shock-absorbers 72, it is hard to achieve a satisfactory buffering effect. Therefore, in case the wheels of the model car hit alien objects or the model car turns abruptly and the car body suffers a shock or centrifugal force, the shock-absorbers often fail to provide sufficient buffering effect and all the shock-absorbers and the entire mounting structure (including chassis 70 ) will jump in accordance with the change of road configuration. In order to more stabilize the gravity center of the car body, the chassis 70 is often such designed as to be lower. This makes the buffering space more reduced. In case of an abrupt or irregular road face, the existent model car with the conventional shock-absorbers can hardly stably run on the road and may turn over due to excessively great shock. Therefore, it is necessary to provide an improved mounting bracket structure for remotely controllable model car to enhance the shock-absorbing ability and stability there of in running.e

SUMMARY OF THE INVENTION

It is therefore a primary object of the present invention to provide an improved mounting bracket structure of remotely controllable toy rally car, which provides double shock-absorbing structures between the mounting bracket and the front and rear support racks. The mounting bracket structure includes a mounting bracket, intersecting linkages, rebounding shock-absorbers and front and rear support racks on which wheels are mounted. The mounting bracket includes at least two lateral supports racks. Each intersecting linkage includes two intersecting links. The intersecting linkages are connected between the bottom side of the mounting bracket and the front and rear support racks near the gravity center of the mounting bracket so as to concentratively support the mounting bracket. The rebounding shock-absorbers are bridged between outer ends of the lateral support racks and the outer ends of the intersecting linkages. The height of the mounting bracket is increased and the mounting bracket itself is adapted to poor road condition and has a resilient shock-absorbing ability against lateral tilting to assist the shock-absorbers disposed between the wheels and the front and rear support racks. Therefore, when running on a road with poor road face, the toy rally car can still run stably without possibility of over-shocking or lateral tilting.

The present invention can be best understood through the following description and accompanying drawings wherein:

BRIEF DESCRIPTION OF THE DRAWINGS

FIG. 4 shows that the toy rally car of the present invention runs on an irregular road face in one state;

DETAILED DESCRIPTION OF THE PREFERRED EMBODIMENT

Figure 1:
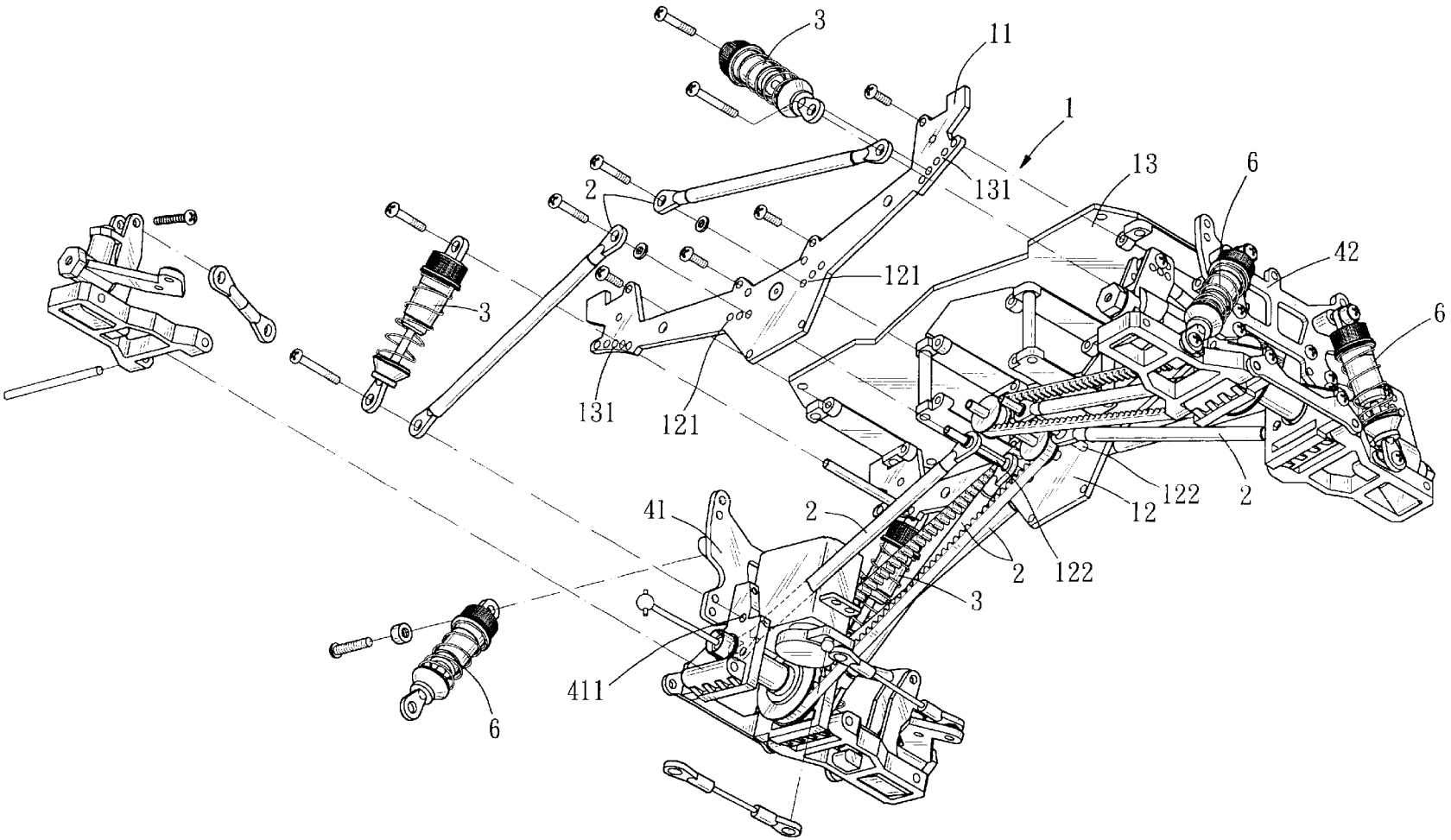
FIG. 1 is a perspective exploded view of the present invention.
Figure 2:
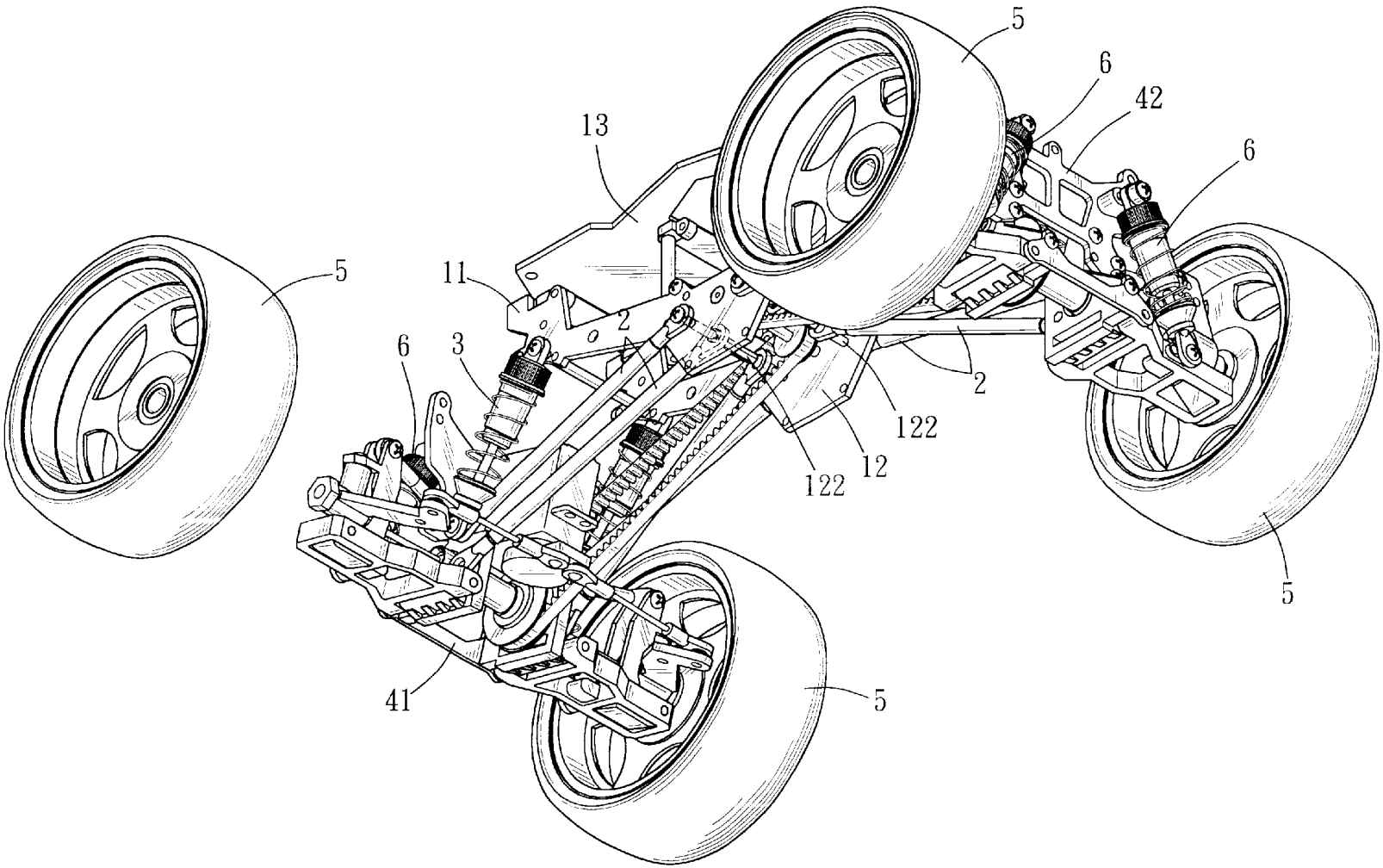
FIG. 2 is a perspective assembled view of the mounting bracket, shock-absorbers and linkages of the present invention.
Figure 3:
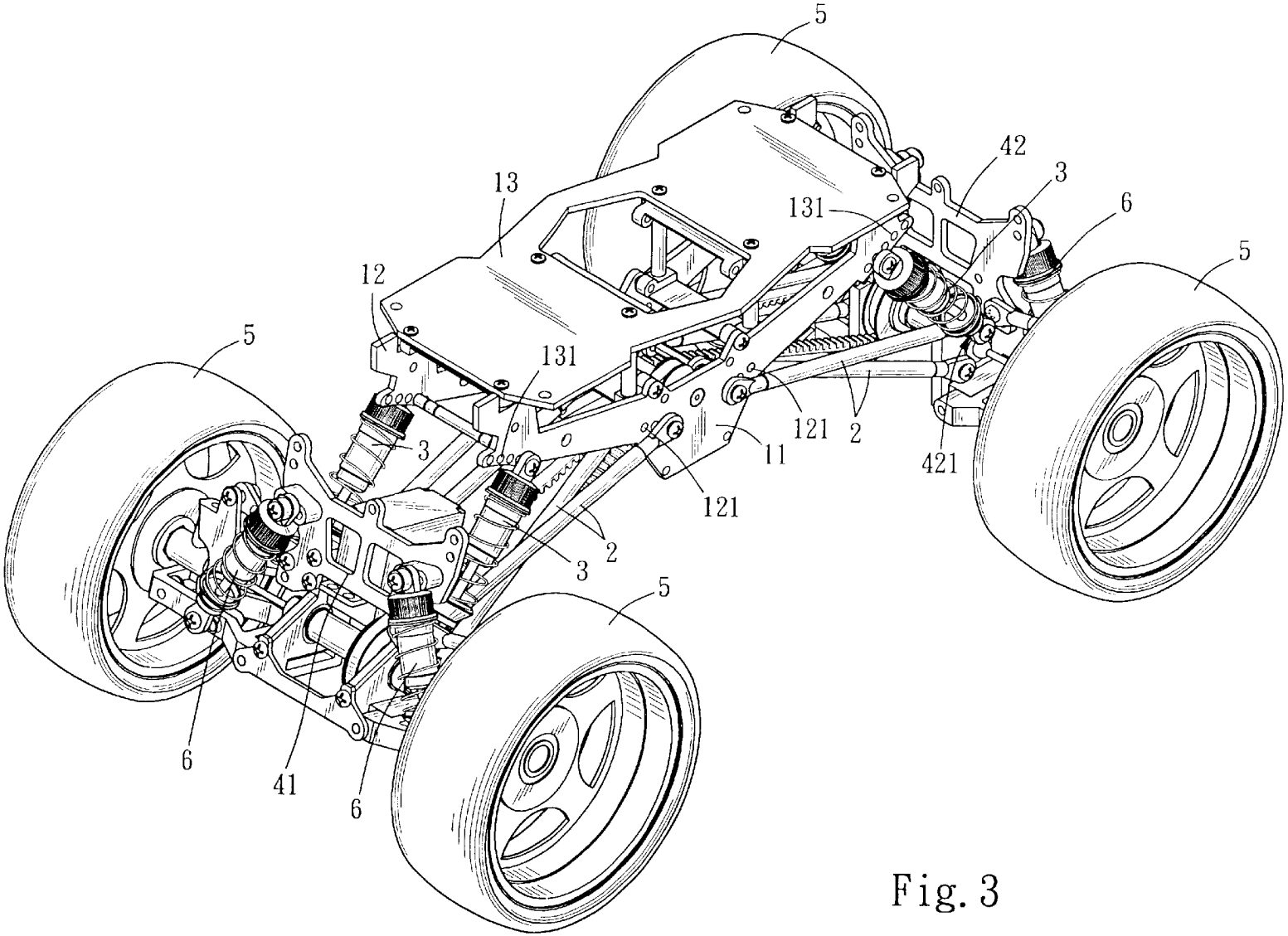
FIG. 3 is a perspective assembled view of the present invention.

Please refer to FIGS. 1, 2 and 3. The mounting bracket structure of remotely controllable toy rally car of the present invention includes a mounting bracket 1, intersecting linkages 2 and rebounding shock-absorbers 3. The mounting bracket 1 is composed of two lateral supports racks 11, 12 (substantially V-shaped rack bodies ) and a seat board 13 retained by the lateral support racks 11, 12. The mounting bracket 1 defines an internal space in which a transmission and power supply (not shown ) are mounted. Each of the intersecting linkages 2 is composed of two intersecting links for supporting the mounting bracket 1. One end of each intersecting linkage 2 is connected to the mounting bracket 1 between the lateral support racks 11, 12 near the gravity center of the mounting bracket 1. The other end of the intersecting linkage 2 is respectively locked on a front and a rear support racks 41, 42 on which wheels 5 are mounted. Accordingly, the arrangement serves to concentratively support the mounting bracket 1 at the gravity center thereof. One end of each intersecting linkage 2 is fixed on the fixing rods 122 connected between the locating holes 121 of the bottoms of the lateral support racks 11, 12. Therefore, the intersecting linkages 2 are positioned near the gravity center of the mounting bracket. The other end of the intersecting linkage 2 is fixed on the front and rear support racks 41, 42 of the car body 4, whereby the intersecting linkages 2 serve to provide a supporting force arm for the mounting bracket 1. In addition, the end sections of the rebounding shock-absorbers 3 are respectively bridged between outer ends of the lateral support racks 11, 12 and the outer ends of the intersecting linkages 2. The front and rear sides of the lateral support racks 11, 12 are formed with adjustment holes 131. The front and rear support racks 41, 42 are correspondingly formed with through holes 411, 421. The rebounding shock-absorbers 3 are respectively bridged between the adjustment holes 131 and the through holes 411, 421. Therefore, the rebounding shock-absorbers 3 are bridged between the outer ends of the lateral support racks 11, 12 and the outer ends of the intersecting linkages 2. This increases the height of the mounting bracket 1 and the mounting bracket 1 itself has a resilient buffering ability between the mounting bracket 1 and the front and rear support racks 41, 42 so as to absorb the shock caused by poor road condition or lateral tilting. Accordingly, in running, the shock-absorbing ability of the mounting bracket 1 is enhanced to assist the shock-absorbers 6 disposed between the wheels 5 and the support racks 41, 42.

Figure 4:
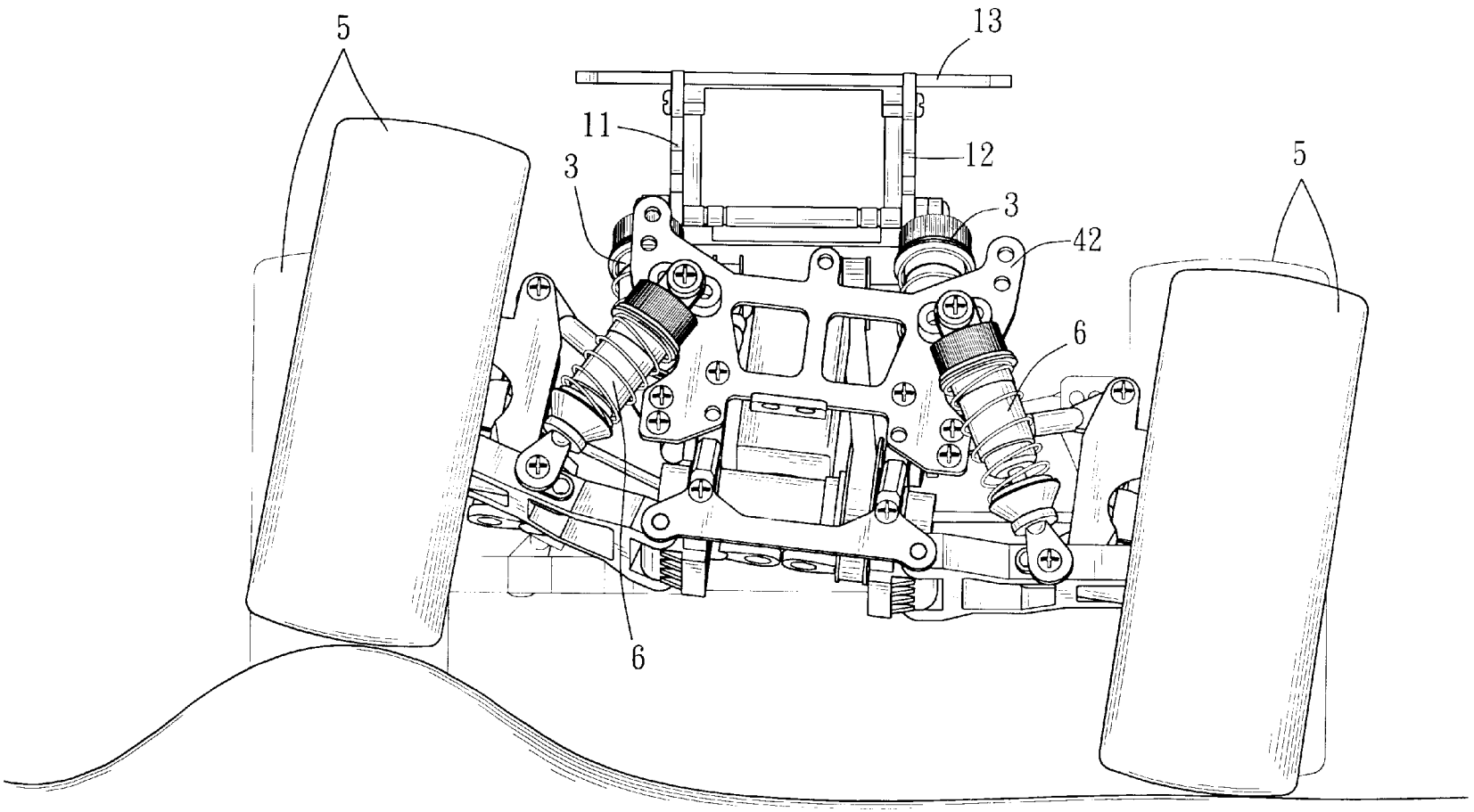
FIG. 4 shows that the toy rally car of the present invention runs on an irregular road face.
Figure 5:
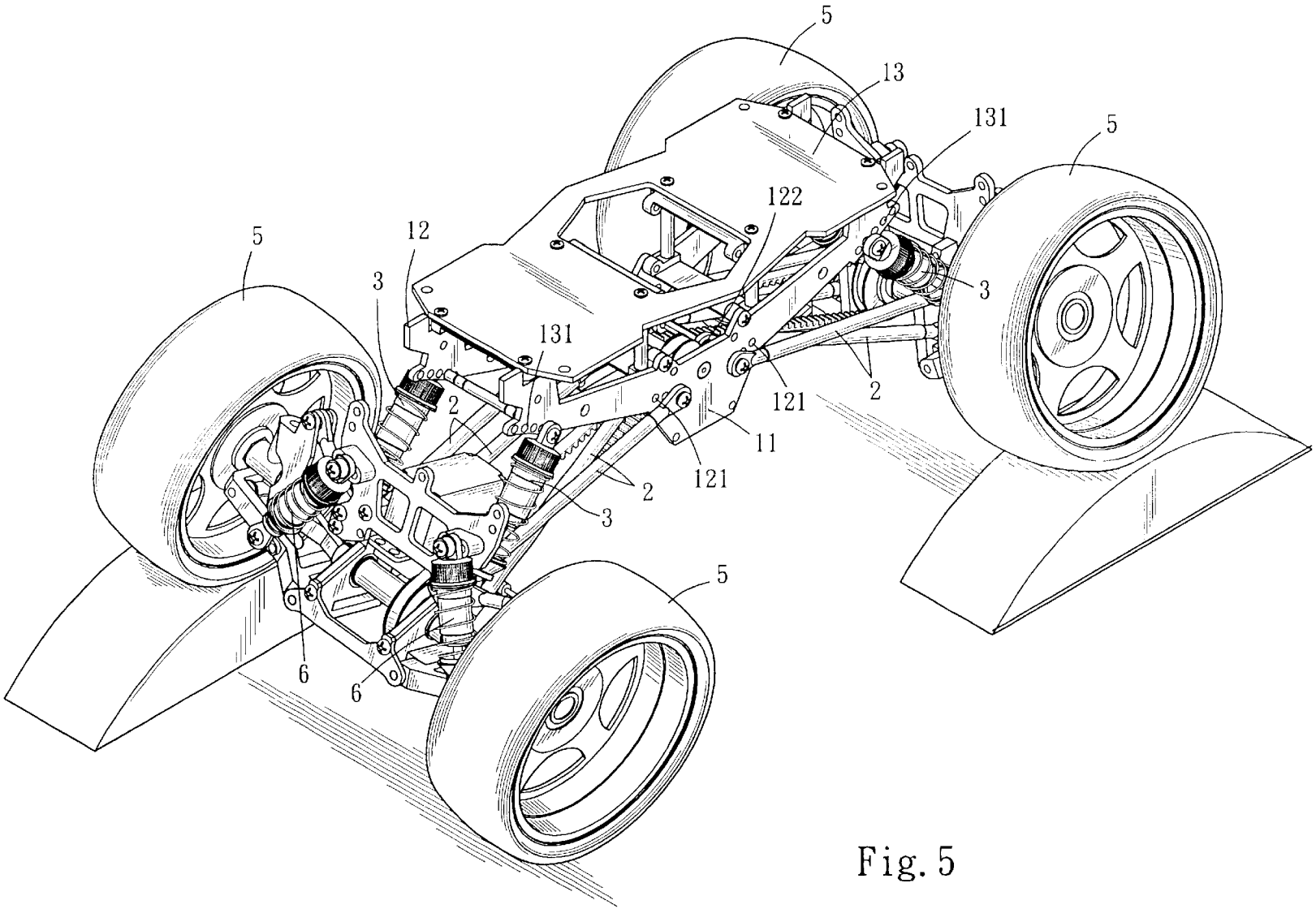
FIG. 5 shows that the toy rally car of the present invention runs on an irregular road face in another state.
Figure 6:
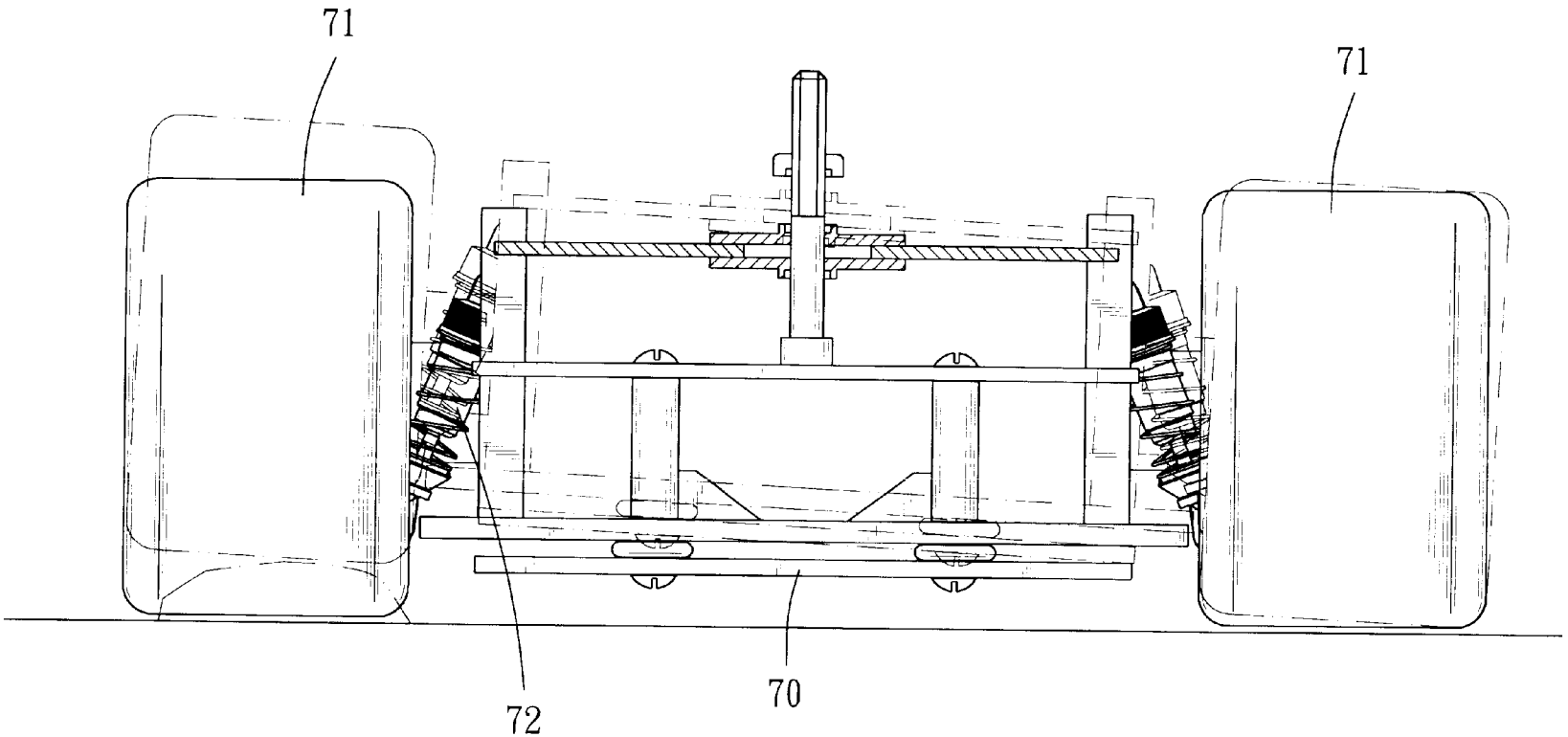
FIG. 6 shows a conventional model car in a shocked state.

Please refer to FIGS. 4 and 5. According to the above mounting bracket structure of the present invention, the mounting bracket 1 and the front and rear support racks 41, 42 are supported in a buffered state. In the case that the wheels 5 mounted under the support racks 41, 42 are shocked by alien objects, the shock is first absorbed by the shock-absorbers 6 mounted between the front and rear support racks 41, 42 and the wheels 5. In case the shocking force exceeds a certain value which the shock-absorbers 6 can hardly bear, the excessive shocking force can be further absorbed by the rebounding shock-absorbers 3. Therefore, the mounting bracket 1 can keep stable during running. Moreover, in the case that the car body is laterally tilted due to centrifugal force in turning, the intersecting linkages 2 connected between the mounting bracket 1 and the front and rear support racks 41, 42 can cooperate with the rebounding shock-absorbers 3 for providing an offsetting torque. This provides the mounting bracket 1 with an anti-lateral tilting or anti-lateral deflection effect. Therefore, the toy rally car is better adapted to poor road condition and has better running ability.

The above embodiment is only used to illustrate the present invention, not intended to limit the scope thereof. Many modifications of the above embodiment can be made without departing from the spirit of the present invention.

What is claimed is:

1. Mounting bracket structure of remotely controllable toy rally car, comprising a mounting bracket, intersecting linkages, rebounding shock-absorbers and front and rear support racks on which wheels are mounted, the mounting bracket including lateral supports racks, each intersecting linkage including two intersecting links, the intersecting linkages and the rebounding shock-absorbers being connected between the mounting bracket and the front and rear support racks to support the mounting bracket, the intersecting linkages being respectively connected between a bottom side of the mounting bracket and the front and rear support racks, the rebounding shock-absorbers being bridged between outer ends of the lateral support racks and outer ends of the intersecting linkages, whereby the height of the mounting bracket is increased and the mounting bracket itself is adapted to poor road condition and has a resilient shock-absorbing ability against lateral tilting and thus the toy rally car can run more stably.

2. Mounting bracket structure of remotely controllable toy rally car as claimed in claim 1, wherein the mounting bracket is composed of two lateral supports racks and a seat board retained by the lateral support racks.

3. Mounting bracket structure of remotely controllable toy rally car as claimed in claim 1, wherein one end of each intersecting linkage is connected to the mounting bracket between the lateral support racks near the gravity center of the mounting bracket, the other end of the intersecting linkage being respectively locked on the front and a rear support racks.

4. Mounting bracket structure of remotely controllable toy rally car as claimed in claim 2, wherein one end of each intersecting linkage is connected to the mounting bracket between the lateral support racks near the gravity center of the mounting bracket, the other end of the intersecting linkage being respectively locked on the front and a rear support racks.

5. Mounting bracket structure of remotely controllable toy rally car as claimed in claim 1, wherein a front and a rear ends of the lateral support racks are formed with adjustment holes and the front and rear support racks are correspondingly formed with through holes, whereby the rebounding shock-absorbers are respectively bridged between the adjustment holes and the through holes.

6. Mounting bracket structure of remotely controllable toy rally car as claimed in claim 2, wherein a front and a rear ends of the lateral support racks are formed with adjustment holes and the front and rear support racks are correspondingly formed with through holes, whereby the rebounding shock-absorbers are respectively bridged between the adjustment holes and the through holes.

7. Mounting bracket structure of remotely controllable toy rally car as claimed in claim 3, wherein a front and a rear ends of the lateral support racks are formed with adjustment holes and the front and rear support racks are correspondingly formed with through holes, whereby the rebounding shock-absorbers are respectively bridged between the adjustment holes and the through holes.

8. Mounting bracket structure of remotely controllable toy rally car as claimed in claim 4, wherein a front and a rear ends of the lateral support racks are formed with adjustment holes and the front and rear support racks are correspondingly formed with through holes, whereby the rebounding shock-absorbers are respectively bridged between the adjustment holes and the through holes.

9. Mounting bracket structure of remotely controllable toy rally car as claimed in claim 1, wherein the lateral support rack is substantially V-shaped.

10. Mounting bracket structure of remotely controllable toy rally car as claimed in claim 2, wherein the lateral support rack is substantially V-shaped.

11. Mounting bracket structure of remotely controllable toy rally car as claimed in claim 3, wherein the lateral support rack is substantially V-shaped.

12. Mounting bracket structure of remotely controllable toy rally car as claimed in claim 4, wherein the lateral support rack is substantially V-shaped.

13. Mounting bracket structure of remotely controllable toy rally car as claimed in claim 1, wherein shock-absorbers are disposed between the front and rear support racks and the wheels.

14. Mounting bracket structure of remotely controllable toy rally car as claimed in claim 2, wherein shock-absorbers are disposed between the front and rear support racks and the wheels.

15. Mounting bracket structure of remotely controllable toy rally car as claimed in claim 3, wherein shock-absorbers are disposed between the front and rear support racks and the wheels.

16. Mounting bracket structure of remotely controllable toy rally car as claimed in claim 4, wherein shock-absorbers are disposed between the front and rear support racks and the wheels.

17. Mounting bracket structure of remotely controllable toy rally car as claimed in claim 9, wherein shock-absorbers are disposed between the front and rear support racks and the wheels.

18. Mounting bracket structure of remotely controllable toy rally car as claimed in claim 10, wherein shock-absorbers are disposed between the front and rear support racks and the wheels.

19. Mounting bracket structure of remotely controllable toy rally car as claimed in claim 11, wherein shock-absorbers are disposed between the front and rear support racks and the wheels.

20. Mounting bracket structure of remotely controllable toy rally car as claimed in claim 12, wherein shock-absorbers are disposed between the front and rear support racks and the wheels.

* * * * *